United States Patent [19]

Ziemer et al.

[11] Patent Number: 4,554,766

[45] Date of Patent: Nov. 26, 1985

[54] CEILING CONSTRUCTION FOR CLEAN ROOMS

[75] Inventors: Wolf Ziemer, Berlin; Wilhelm Hölle, Münzenberg, both of Fed. Rep. of Germany

[73] Assignee: Flakt Aktiebolag, Nacka, Sweden

[21] Appl. No.: 642,426

[22] Filed: Aug. 20, 1984

[30] Foreign Application Priority Data

Aug. 24, 1983 [DE] Fed. Rep. of Germany ..... 3330536

[51] Int. Cl.[4] ..... E04H 5/02

[52] U.S. Cl. ..... 52/28; 98/33.1

[58] Field of Search ..... 98/31.5, 31.6, 34.6, 98/33.1, 33 A, 40 DL, 40 D; 52/28, 173 R

[56] References Cited

U.S. PATENT DOCUMENTS

| | | | |
|---|---|---|---|
| 1,518,162 | 12/1924 | Parkinson | 98/34.6 |
| 2,291,220 | 7/1942 | Germonprez | 98/33.1 |
| 3,367,257 | 2/1968 | Raider | 98/34.5 |
| 4,267,769 | 5/1981 | Davis et al. | 98/31.5 |

*Primary Examiner*—Lenard A. Footland

*Attorney, Agent, or Firm*—Dann, Dorfman, Herrell and Skillman

[57] ABSTRACT

Ceiling construction for clean rooms in which beneath a main ceiling (3) a lower ceiling (18) is mounted which is formed by a light and air permeable capillary structure (19), so that, with a high light transmission factor in respect of optimal and simultaneously dazzle free illumination of the clean room a turbulence-free laminar air flow is possible in the clean room.

6 Claims, 2 Drawing Figures

CEILING CONSTRUCTION FOR CLEAN ROOMS

Figure 1:
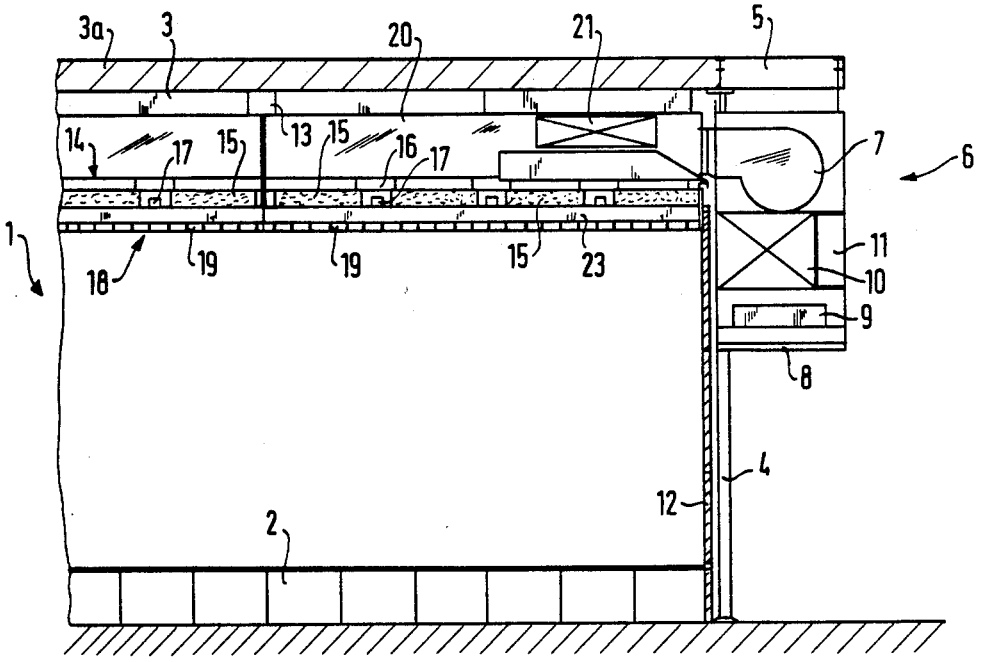

The invention relates to a ceiling construction for clean rooms comprising an intermediate ceiling arranged beneath and spaced from the raw ceiling surface to form a pressure chamber, which intermediate ceiling is formed of heavy duty mechanical filters, comprising a lower ceiling arranged beneath and spaced from the intermediate ceiling to form an air distribution chamber which is formed from laminar elements having vertical passage openings for a vertical downwardly directed air flow, and ceiling lamps.

In various branches of industry, in which manufacturing and assembly operations must be carried out in the conditions of particularly high cleanliness, it has proved necessary to make available working rooms having a controlled low particle air flow which are known under the term "white rooms" or "clean rooms".

The definition of the purity of the air in such clean rooms and the principles for achieving this requirement are known from various publications such as VDI 2083, page 1 (December 1976), page 2 (December 1977), and page 3 (February 1983) and also from US Federal Standard 209 b (April 1973). One of these principles is the vertical low turbulance displacement or piston flow, also known as "Vertical Laminar Flow"="VLF", in which the air is conducted in a temperature, humidity and speed regulated manner, via a mechanical filter ceiling by means of an air supply apparatus. The mechanical filter ceiling should in connection with the air supply apparatus achieve a particle free air flow having a flow velocity which is uniform over the ceiling area. This ceiling should furthermore also fullfill further functions such as air distribution, air filtering and illumination of the room.

In a ceiling construction for clean rooms of the above described type (DE-OS No. 2 028 777) the laminar elements of the lower ceiling are formed by means of perforated sheets and the ceiling lamps are arranged below this lower ceiling or in the area of the same. In this connection, the perforated sheets of the lower ceiling provide in substance contact protection for the heavy duty mechanical filter as filter paper is known to be very sensitive to contact. However, its apertures, which are only very short apertures cannot achieve sufficiently good laminar flow. Moreover, the ceiling lamps arranged beneath the lower ceiling or in the area of the same in the form of fluorescent tubes lead, as a result of convection and as a result of their disturbing function as an obstruction, to turbulence in the air flow which unfavourably affects the laminar properties of the air flow. Finally, the fluorescent tubes do not supply a uniform and dazzle free illumination. A dazzle free arrangement of the ceiling lamps would lead to an enlargement of the lamp construction as such with the consequence, as a result of the above mentioned effect, the turbulent influence on the air flow would be even larger.

It is an object of the invention to develope the ceiling construction of the above mentioned type in such a manner that over the entire ceiling surface a vertical turbulence free, i.e. laminar, air flow is ensured and in addition a uniform and dazzle free illumination of the clean room is achieved.

This object is satisfied by the features given in claim 1.

By the feature that the laminar elements of the lower ceiling are formed by a capillary structure which is both air permeable and also light permeable, the ceiling lamps can be installed between the mechanical filters. In this way, these no longer lie in the air flow emitted by the ceiling construction so that the air can move vertically downwardly in a laminar flow through the clean room. As a result of the capillary structure of the lower ceiling, in co-operation with the mechanical filters arranged thereover, a largely laminar flow is achieved over the entire ceiling surface. As a result of the high laminarity of this thus formed displacement flow over the entire horizontal cross section of the clean room, partical emitting bodies are surrounded by the flow so that the particles are carried away by the shorted path—without cross contamination—downwardly from the clean room.

A further advantage of the solution according to the invention consists in that the capillary structure has a high light transmission factor as a result of the light conducting effect of its tubes and for that reason a uniform and in addition dazzle free illumination of the clean room equipped with this is ensured. This is a consequence of the high light transmission of the capillary structure with simultaneous dispersion which ensures a diffuse illumination of the room without long shadows.

A ceiling construction for clean rooms of the above mentioned type is known from U.S. Pat. No. 3,060,025 in which as a spacing beneath the raw ceiling surface a lower ceiling is arranged which itself is formed from two superimposed ceilings which in each case are formed from a plurality of plates. The plates themselves have a plurality of vertical bores as inlets for the air. They are formed from light permeable synthetic material, the upper plates preferably consisting of transparent material and the lower plates of transluscent material. The lamps are secured on the main ceiling. In the ceiling construction from a central processing unit appropriately processed and filtered pressurized air is introduced into the pressure chamber formed between the main ceiling and the first ceiling of the double ceiling. From there, the inlet air passes through the vertical apertures of the plates of the first ceiling into the space between the two ceilings of the double ceiling and from there through the vertical apertures of the second ceiling of the double ceiling into the clean room. By means of this briefly described arrangement a "laminar flow" is supposed to be achieved. This term can however not be meant in the sense of a displacement flow. The displacement flow itself cannot be turbulence free because the free apertures surfaces of the double ceiling constructed as indicated occupy only 2 to 5% of the total surface of the ceiling construction and for that reason on the basis of the large distance between the vertical inlets in the plates injection takes place on the clean room side thereby causing a corresponding turbulence of the air introduced into the clean room. A futher disadvantage of the double ceiling of this ceiling construction formed from light and air permeable plates consists in that the two plate constructions arranged behind one another absorb a relatively large amount of light. Moreover, the illumination is not dazzle free. Finally, a further disadvantage of this system consists in that it is dependent upon one central processing installation for the inlet air whereby, upon failure of this unit, all clean rooms are placed out of operation.

According to a preferred further development of the solution according to the invention, the capillary structure of the capillary plates has capillary tubes which are approximately 1 mm wide and about 50 mm long with about 85% free surface. By this means an extremely high not previously achieved air permeability of the ceiling construction according to the invention is achieved.

According to a further embodiment of the inventive thought, the capillary structure plates or their tubes are spun from polycarbonate, these tubes being welded together to form the capillary structure. As a result, the capillary structure plates have a high resistance to distortion with the consequence that even with ceilings of large span bending of the plates does not occur.

The known capillary structure plates were previously used as heat insulating layers between two glass plates or synthetic material plates or as elements for sun collectors (Bild der Wissenschaft No. 2-1983, page 106) as "sun traps". The use according to the invention of these capillary structure plates is thus new and achieves, as indicated, a surprising effect, since in addition to the optimal light transmission its properties are used to achieve a laminar air flow.

According to a further development of the ceiling construction according to the invention, the intermediate ceiling comprises a frame construction in which the filters and lamps and further necessary constructional elements for the clean room, such as the entire electrotechnical cable assembly for normal lighting, emergency lighting, intercom systems, fire alarm systems etc. are integrated to form a system which is sealed against the entry of particles.

Furthermore, according to the invention, on the end sides (connection to the ventilator part) of the intermediate wall a connection plate profile can be mounted for connection in a manner sealed against particle entry to a clean room wall of arbitrary thickness (normal case 50 mm).

It is of particular advantage that the measurements of the self-supporting profile frame construction are adapted to the European frame dimension 600×600. By this means a good room arrangement can be achieved without a necessity for dimensional changes during the installation of the usual elements such as walls, double bottoms, etc. In the following the invention will be further explained on the basis of an exemplary embodiment with reference to the drawing in which FIG. 1 shows a partial vertical section through a clean room having a ceiling construction according to the invention, and FIG. 2 shows a partial front of view for the capillary structured plate in the form in which such plates can be employed in the ceiling construction according to the invention.

Figure 2:
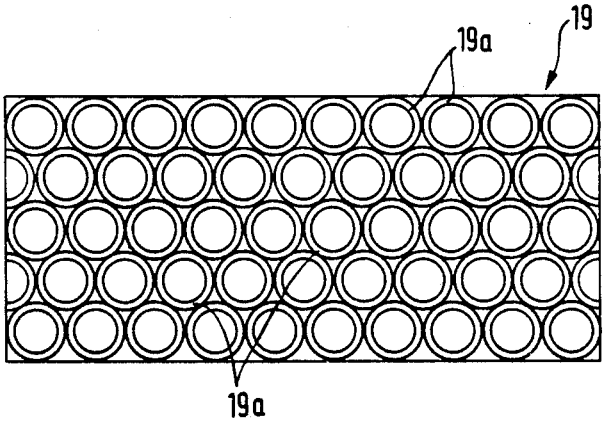

The clean room 1 illustrated in FIG. 1 is constructed in the form of a room modul which individually or in plurality can be installed in any arbitrary hall or any appropriately large room. The ceiling construction according to the invention can however independently of this be installed in already existing rooms, in particular if appropriate possibilities are provided for mounting the ventilator parts.

This clean room 1 has a floor too, which can be an apertured double bottom. At an appropriate spacing above the floor 2 a main ceiling 3 is arranged which is carried by steel construction 3*a* which rests on vertical supports 4. The clean room 1 is furthermore limited on its four sides by vertical walls 12 which preferably have a thickness of 5 cm.

The steel construction 3*a* has a horizontally extending carrier 5 on which a ventilator part 6 is mounted. The ventilator part 6 receives inter alia ventilators 7 which can preferably be radial ventilators, prefilters 8, cooler 9, noise damper 10 and switch box 11. By this means, the air to be brought into the clean room 1 by the ventilator 7 is already prefiltered and cooled and also the noise level of the ventilator is reduced.

Beneath the main ceiling 3, an intermediate ceiling designated with 14 is arranged at a predetermined spacing by means of a suspension 13 connected to the steel construction 3*a*. It consists of adjacently arranged plate like mechanical filters 15 which are preferably HEPA-filters with measurements of 762×726×150 mm. These filters are installed in a frame construction 16 secured on the suspension 13 and held therein preferably with high-grade steel clamping shoes. Between the filters 15 in the frame construction 16 lamps 17 are so arranged in the illustrated embodiment, that their lower sides are flush with the lower sides of the filters 15. Mechanical filters 15, lamps 17 and the further usual installation parts are installed in the frame construction 16 in such manner as to be sealed against particles. The frame construction 16 permits furthermore connection sealed against particle entry to adjoining room modules both on its end sides and also on its longitudinal sides.

Between the main ceiling 3 and the intermediate ceiling 14 is provided a pressure chamber 20 into which the outlet opening of the ventilator 7 discharges. Connected in series to this and integrated into the pressure chamber 20, are provided a noise damper 21, which can be a diffusor noise damper, and a baffle plate. By this means a particularly low noise level is achieved.

Beneath the intermediate ceiling 14 is located finally a lower ceiling 18 which is expediently suspended from the frame construction 16. The ceiling 18 is formed from plates 19 which have a capillary structure which is schematically illustrated in FIG. 2. The capillary structure consists of capillary tubes 19*a* approximately 1 mm wide and about 50 mm long which enable in total a free surface of about 85%. The capillary structure is thereby permeable to air. The flow through the capillaries takes place at Reynolds numbers less than 50, whereby a truly laminar flow is ensured which, after leaving the capillary tubes 19*a*, is superimposed at most on a small turbulence caused by the small wall thickness or the packing spaces which have not received any flow. The capillary structure is moreover light transmissible in the sense that the light rays of the light sources 17 mounted above the capillary structure ensure with almost total reflection on the capillary tube inner walls a uniform dazzle free illumination. The so arranged and constructed capillary structure provides on the one hand with only low pressure loss a vertical laminar flow and on the other hand a good, dazzle free illumination which is important for example for electronic data processing work places.

The capillary structure plates 19 can be manufactured from highly transparent polycarbonate, the capillary tubes being arranged a right angles to the plane of the plate and being fixed together with an adhesive. They can however also be manufactured from glass or other appropriate transparent materials. These capillary structure plates have in addition a property of bearing load relatively well so that plates 19 of relatively large dimensions can be used to form the lower ceiling 18 without fear of bending.

Between the intermediate ceiling 14 and the lower ceiling 18 is constructed an air distribution chamber 23 which receives air under the pressure from the pressure chamber 20 through the filter 15 and passes substantially uniformly distributed through the capillary openings of the capillary structure plates 19.

Frame construction 16 consists of profiled Sendzimir galvanised steel sheet and is, as already explained, so constructed that it assumes beside the carrying function also a sealing function. That it is to say in respect of the reception of the filters 15 and the reception of the lamps 17 and installation cables in a manner sealed against particles. A sprinkler conductor and a sprinkler head can be integrated in a manner sealed against particles into the frame construction 16 and further installations such as for example electro-acustic operators, ionisation detectors and the like can also be arranged.

We claim:

1. Ceiling construction for clean rooms comprising:

an intermediate ceiling arranged at a spacing beneath a raw ceiling to form a pressure chamber, which intermediate ceiling is formed from heavy duty mechanical filters:

a lower ceiling arranged at a spacing beneath the intermediate ceiling to form an air distribution chamber, which lower ceiling is formed from laminar elements having vertical passages for a vertically downwardly directed air flow: and ceiling lamps, wherein the laminar elements of the lower ceiling are formed by a capillary structure which is both air permeable and also light permeable, and the ceiling lamps are installed above the lower ceiling between the mechanical filters.

2. Ceiling construction according to claim 1, wherein capillary structure of the capillary plates has capillary tubes which are approximately 1 mm wide and about 50 mm long with approximately 85% exposed outer surface.

3. Ceiling construction according to claim 2, wherein the intermediate ceiling is provided with a connection plate profile for the connection to a clean room wall in a manner sealed against particles.

4. Ceiling construction according to claim 2, wherein capillary structure plates are manufactured of polycarbonate.

5. Ceiling construction according to claim 1, wherein the intermediate ceiling comprises a frame construction in which the source and lamps elements are installed to form a system sealed against particles.

6. Ceiling construction according to claim 5, wherein the dimensions of the frame construction correspond to the European frame size 600×600 mm.

* * * * *

UNITED STATES PATENT AND TRADEMARK OFFICE

CERTIFICATE OF CORRECTION

PATENT NO. : 4,554,766

DATED : November 26, 1985

INVENTOR(S) : Wolf Ziemer and Wilhelm Holle

It is certified that error appears in the above-identified patent and that said Letters Patent is hereby corrected as shown below:

Column 2, line 29, "3,060,025" should read --4,060,025--.
Column 4, line 17, "726" should read --762--.

Signed and Sealed this

*Eighteenth* Day of *February 1986*

[SEAL]

*Attest:*

DONALD J. QUIGG

*Attesting Officer*

*Commissioner of Patents and Trademarks*